US010083650B2

(12) United States Patent
Jung et al.

(10) Patent No.: US 10,083,650 B2
(45) Date of Patent: Sep. 25, 2018

(54) LED DISPLAY MODULE, DISPLAY APPARATUS AND CONTROLLING METHOD THEREOF

(71) Applicant: SAMSUNG ELECTRONICS CO., LTD., Suwon-si (KR)

(72) Inventors: Jong-hoon Jung, Suwon-si (KR); Young-mok Park, Asan-si (KR); Sang-moo Park, Yongin-si (KR); Seong-woo Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 57 days.

(21) Appl. No.: 15/265,272

(22) Filed: Sep. 14, 2016

(65) Prior Publication Data

US 2017/0309222 A1 Oct. 26, 2017

(30) Foreign Application Priority Data

Apr. 25, 2016 (KR) ..... 10-2016-0050282

(51) Int. Cl.
*G09G 3/32* (2016.01)

(52) U.S. Cl.
CPC ..... *G09G 3/32* (2013.01); *G09G 2310/0264* (2013.01); *G09G 2310/06* (2013.01); *G09G 2330/021* (2013.01)

(58) Field of Classification Search
None
See application file for complete search history.

(56) References Cited

U.S. PATENT DOCUMENTS

2007/0222716 A1 9/2007 Huang et al.
2009/0153078 A1* 6/2009 Lin ..... G09G 3/3216 315/312

(Continued)

FOREIGN PATENT DOCUMENTS

JP 6-282763 A 10/1994
JP 8-278764 A 10/1996

(Continued)

OTHER PUBLICATIONS

International Search Report dated Feb. 3, 2017 issued by the International Searching Authority in counterpart International Application PCT/KR2016/012435 (PCT/ISA/210).

(Continued)

*Primary Examiner* — Nicholas Lee
(74) *Attorney, Agent, or Firm* — Sughrue Mion, PLLC

(57) ABSTRACT

An LED display module, a display apparatus, and a method for controlling the LED display module and the display apparatus are provided. The LED display module includes a plurality of first LEDs arranged in a first line and a plurality of second LEDs arranged in a second line; a plurality of source interfaces, each of which is commonly connected to an anode of a corresponding one of the plurality of first LEDs and a cathode of a corresponding one of the plurality of second LEDs arranged in the same column as the corresponding one of the plurality of first LEDs; and a gate interface commonly connected to a cathode of each of the plurality of the first LEDs and an anode of each of the plurality of the second LEDs.

14 Claims, 8 Drawing Sheets

(56) References Cited

U.S. PATENT DOCUMENTS

| | | | | |
|---|---|---|---|---|
| 2013/0314307 | A1* | 11/2013 | Lin | G09G 3/32 345/82 |
| 2015/0009105 | A1 | 1/2015 | Nomura | |
| 2015/0061979 | A1 | 3/2015 | Suzuki et al. | |
| 2015/0109190 | A1 | 4/2015 | Li et al. | |
| 2016/0218143 | A1* | 7/2016 | Chaji | H01L 27/156 |

FOREIGN PATENT DOCUMENTS

| | | | |
|---|---|---|---|
| JP | 2006-251816 | A | 9/2006 |
| JP | 2007-24929 | A | 2/2007 |
| KR | 10-2013-0116126 | A | 10/2013 |

OTHER PUBLICATIONS

Written Opinion dated Feb. 3, 2017 issued by the International Searching Authority in counterpart International Application PCT/KR2016/012435 (PCT/ISA/237).

NerdKits; DIY Marquee LED Array Display; 2009; (http://web.archive.org/ web/20090125013241/http://www.nerdkits.com/videos/ledarray2/).

* cited by examiner

LED DISPLAY MODULE, DISPLAY APPARATUS AND CONTROLLING METHOD THEREOF

CROSS-REFERENCE TO RELATED APPLICATIONS

This application claims priority from Korean Patent Application No. 10-2016-0050282, filed in the Korean Intellectual Property Office on Apr. 25, 2016, the disclosure of which is incorporated herein by reference in its entirety.

BACKGROUND

Field

Apparatuses and methods consistent with exemplary embodiments relate to a light-emitting diode (LED) display module, a display device, and a method for controlling the LED display module and the display device, and more particularly, to an LED display module which receives an image signal via a signal interface and displays the received image signal, a display device, and a method for controlling thereof.

Description of the Related Art

Recently, a display apparatus which includes various types of display panels has been developed along with development of technology. In the past, a display apparatus including a cathode ray tube (CRT) and a liquid crystal display (LCD) has been developed. Recently, a display apparatus including a light-emitting diode (LED) module containing organic LED (OLED) has been developed.

An LED display apparatus can be embodied by combining a plurality of LED modules. In addition, the LED display module includes a plurality of LEDs. An anode and a cathode of each LED are connected to a signal interface. The LED display apparatus transmits a signal to each signal interface according to a displayed image, and the LED connected to each signal interface flickers according to potential difference of an input signal. In addition, a user can recognize an image which appears according to the flickering LED.

As illustrated in FIG. 1, an LED module of a related art LED display apparatus includes a signal interface which is common in a column of length direction and a signal interface which is common in a column of width direction. For example, as illustrated in FIG. 1, the LED module which is disposed as 3×3 includes three signal interfaces of a column of width direction and three signal interfaces of a column of length direction, totaling six signal interfaces. For example, when an S1 signal is relatively high and a G1 signal is relatively low, diode D1 is turned on, and when the S1 signal is relatively high and a G2 signal is relatively low, diode D4 is turned on. If each LED corresponds to one pixel and a display panel for which a resolution is 1920×1080 and a capability of displaying full high definition (Full-HD) is embodied, the display panel should include 1920 signal interfaces in the width column and 1080 signal interfaces in the length column. That is, when the related art LED display module is embodied as a large screen, there are problems that arise because the structure becomes complicated, a consumption power increases, and a yield of a display apparatus becomes low.

SUMMARY

One or more exemplary embodiments provide an LED display module and a display apparatus which can simplify structure and can solve many problems, and a controlling method that is implemented by the LED display module and the display apparatus.

According to an aspect of an exemplary embodiment, a light emitting diode (LED) display module includes a plurality of first LEDs arranged in a first line and a plurality of second LEDs arranged in a second line; a plurality of source interfaces, each source interface being commonly connected to an anode of a corresponding one of the plurality of first LEDs and a cathode of a corresponding one of the plurality of second LEDs arranged in the same column as each of the plurality of first LEDs; and a gate interface commonly connected to a cathode of each of the plurality of the first LEDs and an anode of each of the plurality of the second LEDs.

According to an aspect of another exemplary embodiment, a display device includes a power unit and an LED display module, and the LED display module includes a plurality of first LEDs disposed in the first line and a plurality of second LEDs disposed in a second line, a plurality of source interfaces, each source interface being commonly connected to an anode of a corresponding one of the plurality of first LEDs and a cathode of a corresponding one of the plurality of second LEDs arranged in the same column as each of the plurality of first LEDs, and a gate interface commonly connected to a cathode of each of the plurality of the first LEDs and an anode of each of the plurality of the second LEDs.

According to an aspect of another exemplary embodiment, a method for controlling an LED display module including a plurality of first LEDs arranged in a first line and a plurality of second LEDs arranged in a second line includes outputting a first driving signal to each of a plurality of source interfaces which are commonly connected to an anode of a corresponding one of the plurality of first LEDs and a cathode of a corresponding one of the plurality of second LEDs arranged in the same column as each of the plurality of first LEDs, and outputting a second driving signal to a gate interface commonly connected to a cathode of each of the plurality of the first LEDs and an anode of each of the plurality of the second LEDs; and driving at least one LED from among the plurality of first LEDs and the plurality of second LEDs, wherein a phase difference between the first driving signal and the second driving signal is equal to 180 degrees.

BRIEF DESCRIPTION OF THE DRAWINGS

The above and/or other aspects of will be more apparent by describing certain exemplary embodiments with reference to the accompanying drawings, in which.

DETAILED DESCRIPTION

Figure 1:
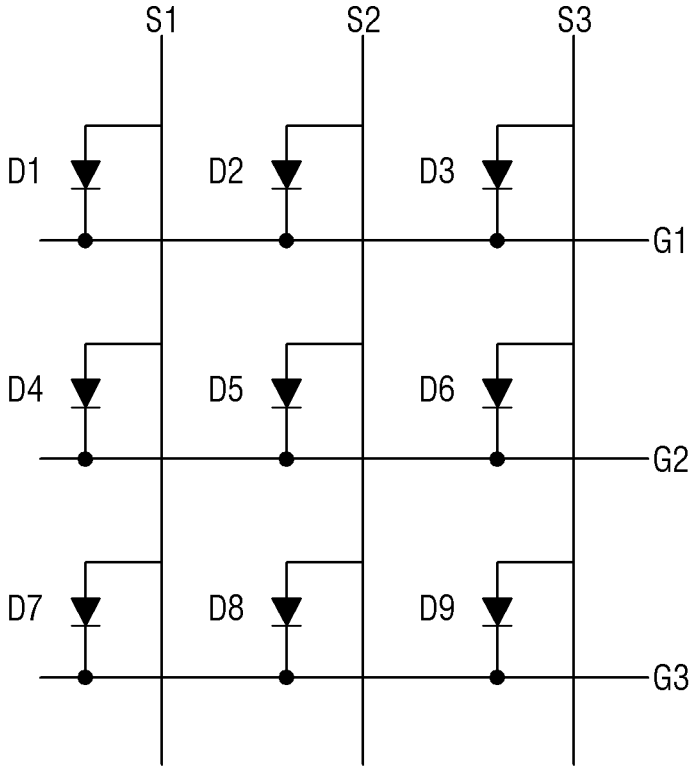
FIG. 1 (RELATED ART)
FIG. 1 is a view describing a structure of the related art LED display module.

Certain exemplary embodiments will now be described in greater detail with reference to the accompanying drawings.

In the following description, the same drawing reference numerals are used for the same elements even in different drawings. The matters defined in the description, such as detailed construction and elements, are provided to assist in a comprehensive understanding of one or more exemplary embodiments. Thus, it is apparent that one or more exemplary embodiments can be carried out without those specifically defined matters. Also, well-known functions or constructions are not described in detail since they would obscure the disclosure with unnecessary detail.

The terms "first", "second", etc. may be used to describe diverse components, but the components are not limited by the terms. The terms are only used to distinguish one component from the others.

The terms used in the present specification are only used to describe the exemplary embodiments, but are not intended to limit the scope of the disclosure. The singular expression also includes the plural meaning as long as it does not conflict therewith in context. In the present specification, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

In exemplary embodiments of the present disclosure, a "module" or a "unit" performs at least one function or operation, and may be implemented with hardware, software, or a combination of hardware and software. In addition, a plurality of "modules" or a plurality of "units" may be integrated into at least one module except for a "module" or a "unit" which has to be implemented with specific hardware, and may be implemented with at least one processor (not shown).

Hereinafter, the exemplary embodiments will be described in detail with reference to the accompanying drawings.

Figure 2:
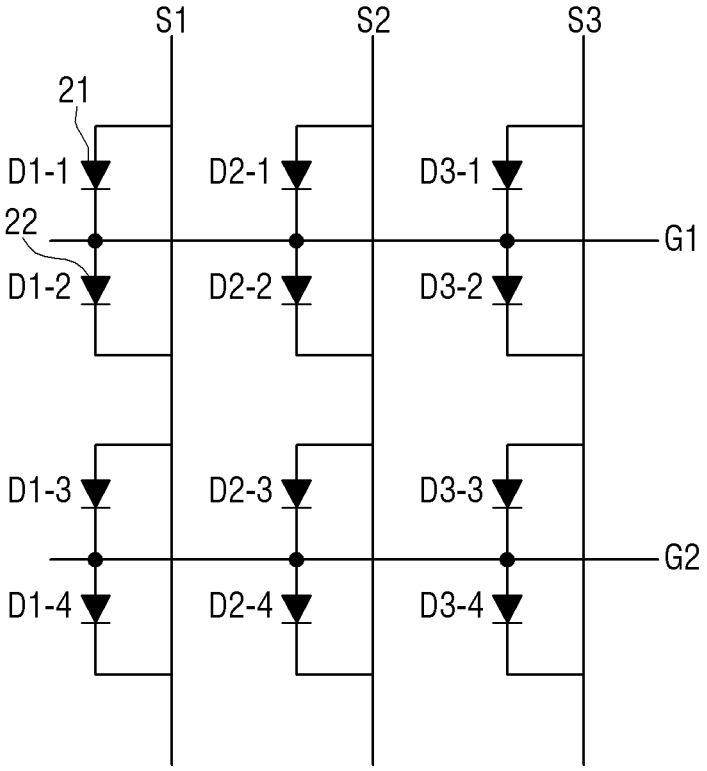
FIG. 2 is a view describing a disposition of LED and interface of the LED display module, according to an exemplary embodiment.

FIG. 2 is a view illustrating disposition of LED of an LED display module and interface, according to an exemplary embodiment.

Referring to FIG. 2, LED parts which include lines of LEDs, source interfaces, and gate interfaces are illustrated. The LED part illustrated in FIG. 2 includes three LEDs (D1-1, D2-1, D3-1) in the first line, three LEDs (D1-2, D2-2, D3-2) in the second line, three LEDs (D1-3, D2-3, D3-3) in the third line, and three LEDs (D1-4, D2-4, D3-4) in the fourth line. The LED part illustrated in FIG. 2 is an exemplary embodiment, and may include various number of lines, various number of columns or LED numbers according to a type, resolution, and implementation type of each of respective LEDs. One LED can output all three of red, green, and blue according to a data signal. Alternatively, each LED can output one of red, green, and blue. Each LED can configure each pixel of a display screen. FIG. 2 illustrates an LED part in which each LED is disposed in accordance with lines and columns, but each LED can be disposed in a diamond shape or crisscross shape.

Each LED can be connected with a source interface and a gate interface. There can be a plurality of source interfaces and a plurality of gate interfaces. If a plurality of LEDs disposed in the first line are a first LED array, and a plurality of LEDs disposed in the second line are a second LED array, the first source interface (S1) can be commonly connected to an anode of one D1-1 (i.e., item 21) of the first LEDs and a cathode of one D1-2 (i.e., item 22) of the second LEDs disposed in the same column. For broader explanation, the source interface can be commonly connected to an anode of LED disposed on an odd-numbered line of a corresponding column and a cathode of LED disposed on an even-numbered line.

In addition, a cathode of a plurality of the first LEDs including D1-1 (21) and an anode of the second LED including D1-2 (22) can be commonly connected to the first gate interface G1.

That is, in the case of LED D1-1 (21) from among the first LED array, the anode can be connected to S1, and the cathode can be connected to G1; in the case of LED D2-1, the anode can be connected to S2, and the cathode can be connected to G1; and in the case of LED D3-1, the anode can be connected to S3, and the cathode can be connected to G1. Similarly, in case of LED D1-2 (22) of the second LED array, the anode can be connected to G1 and the cathode can be connected to S1, in case of LED D2-2, the anode can be connected to G1, and the cathode can be connected to S2, and in case of LED D3-2, the anode can be connected to G1, and the cathode can be connected to S3. Operations are described in greater detail below.

The LED display module illustrated in FIG. 2 can share a gate interface of an even-numbered line and an odd-numbered line. By using the LED display module illustrated in FIG. 2, when a display panel which can display full-HD with resolution of 1920×1080 is embodied, the display panel can include a source interface with 1920 width columns and a gate interface with 540 length columns, which is half of the maximum number of length columns which is 1080. The display panel described in the present specification can be embodied with a gate interface which is half as large as that of the related art display panel as illustrated in FIG. 1, and as a result, power consumption can be reduced due to simple structure.

One or more of the LED display module illustrated in FIG. 2 can be combined to generate a display panel.

Figure 3:
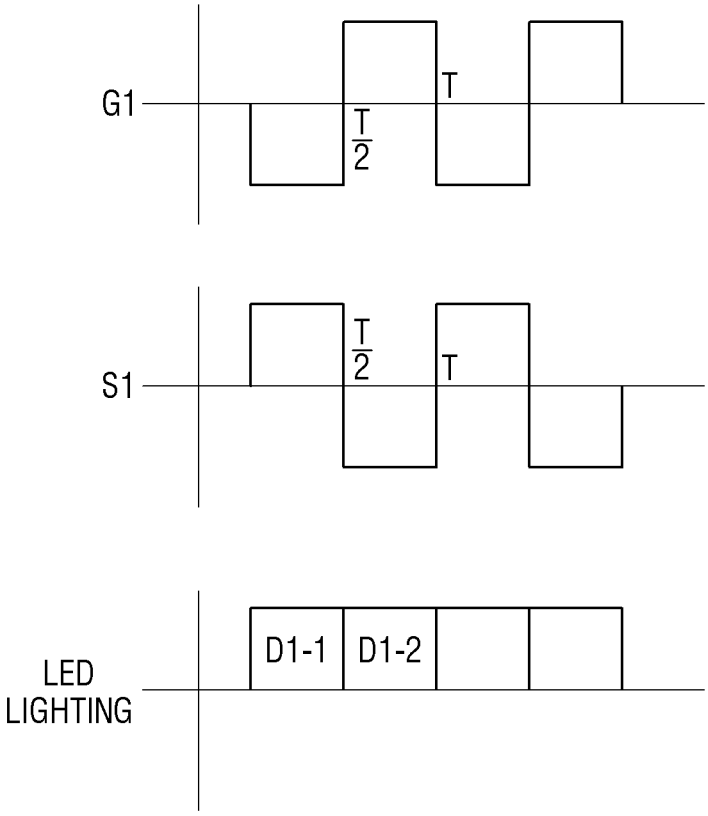
FIG. 3 is a view describing an operation of a display module, according to an exemplary embodiment.

FIG. 3 is a view describing operations of the display module, according to an exemplary embodiment.

FIG. 3 illustrates a source signal and a gate signal. The LED display module, by turning on/off an LED according to a predetermined cycle, can display an image using an afterimage.

The LED display module may turn on and off each LED by applying respective voltages of which a corresponding phase is opposite, to each source interface and gate interface. For example, in case of the LED display module as illustrated in FIG. 2, the first source interface S1 and the first gate interface G1 are respectively connected to the anode and the cathode of LED D1-1 (item 21) which is one of the first LED array, and the anode and the cathode of LED D1-2 (item 22) which is one of the second LED array. That is, the first source interface S1 is connected to the anode of LED D1-1 (item 21), and the first gate interface G1 is connected to the cathode of LED D1-1 (item 21). In addition, the first gate interface G1 is connected to the anode of LED D1-2 (item 22, and the first source interface S1 is connected to the cathode of LED D1-2 (item 22).

As illustrated in FIG. 3, a high signal (i.e., a signal that has a level that is higher than a particular threshold) can be applied to the first source interface S1, and a low signal (i.e., a signal that has a level that is lower than a particular threshold) can be applied to the first gate interface G1. Therefore, the voltage of the anode of LED D1-1 (item 21) can be a high level voltage and the voltage of the cathode can be a low level voltage. Based on these signals, to LED D1-1 (item 21), a voltage in the positive direction is applied, and therefore, LED D1-1 (item 21) can operate to emit light. In this case, the voltage of the anode of LED D1-2 (item 22) is at a low level and the voltage of the cathode can be at a high level. Accordingly, to LED D1-2 (item 22), a voltage in the reverse direction is applied, and thus LED D1-2 (item 22) does not emit light. After one half cycle, a low signal can be applied to the first source interface S1, and a high signal can be applied to the first gate interface G1. Therefore, the voltage of the anode of LED D1-1 (item 21) can be at a low level and the voltage of the cathode can be at a high level. As a result, to LED D1-1 (item 21), a voltage in the reverse direction is applied, and therefore, LED D1-1 (21) does not emit light. In this case, the voltage of the anode of LED D1-2 (item 22) may be at a high level and the voltage of the cathode can be at a low level. Accordingly, a voltage in the positive direction is applied to LED D1-2 (item 22) and thus, LED D1-2 (item 22) emits light.

By repeating the above-described process, the first LED of the first line and the second LED of the second line can be configured to alternatingly emit light. That is, when a signal input to a plurality of source interfaces S1, S2, S3 is high and a signal input to the first gate interface G1 is low, the first LED array of the first line can operate to emit light. When a signal input to a plurality of source interfaces S1, S2, S3 is low and a signal input to the first gate interface G1 is high, the second LED array of the second line can operate to emit light. In this aspect, when a signal input to a plurality of source interfaces S1, S2, S3 is high and a signal input to the first gate interface G1 is low, the first LED array of the first line emits light. That is, the display module can light LEDs on a line-by-line basis.

Alternatively, when signals are sequentially input to a plurality of source interfaces S1, S2, S3, the display module may light LEDs on a pixel-by-pixel basis. In this aspect, when a signal input to the first gate interface G1 is low, initially, a high signal can be input to the first source interface S1, and as a result, LED D1-1 can emit light. Then, a low signal can be input to the first source interface S1 and a high signal can be input to the second source interface S2 at the same time. In this case, LED D2-1 can emit light. At the same time as a low signal is being input to the second source interface S2, a high signal can be input to the third source interface S3.

At this time, LED D3-1 can emit light. At the same time when a low signal is input to the third source interface S3 and a high signal is input to the first source interface S1, a high signal can be input to the first gate interface G1. At this time, LED D1-2 can emit light. In the similar manner as described above, LED D2-2 and LED D3-2 can sequentially emit light. Alternatively, according to an order of combining a signal input to the source interface and a signal input to the gate interface, each of LED D1-1, LED D1-2, LED D2-1, LED D2-2, LED D3-1, and LED D3-2 can be configured to sequentially emit light.

As another alternative, by inputting the same signals to the same number of source interfaces at the same time, a plurality of LEDs corresponding to a predetermined area of a line can be configured to sequentially emit light. By alternatingly applying a high signal and a low signal at a preset frequency to each of the source interface and the gate interface, a user can recognize an image displayed on a display panel that results from an afterimage effect.

Further, the display module may include a driving module which is configured to output a driving signal to the source interface and the gate interface.

Figure 4:
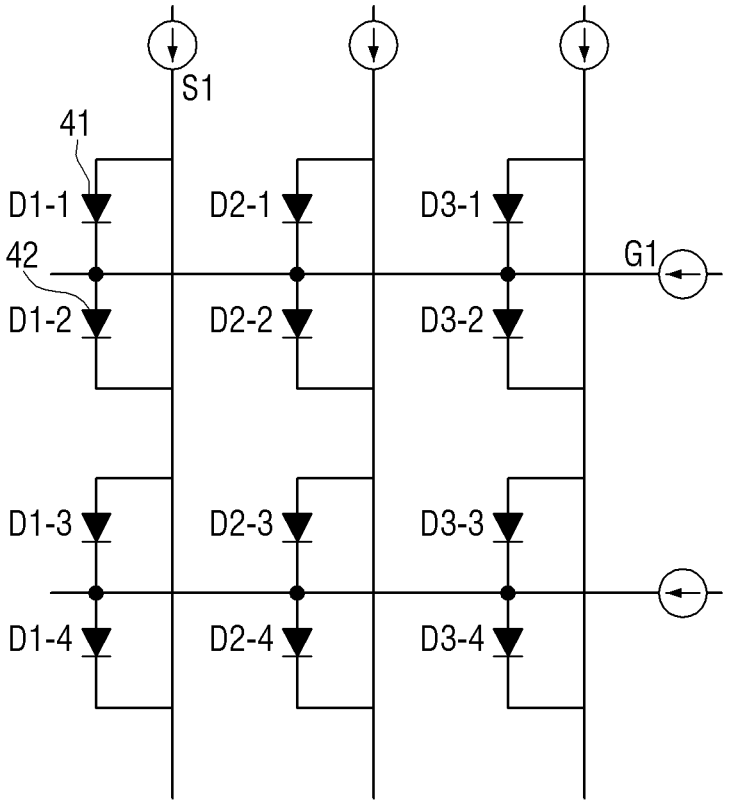
FIG. 4 is a view describing structure of an LED display module, according to an exemplary embodiment.

FIG. 4 is a view illustrating a structure of the LED display module, according to an exemplary embodiment.

Referring to FIG. 4, a drawing in which a driving module is added to the LED display module as illustrated in FIG. 2 is illustrated. Each of the current sources added to the source interface and the gate interface may indicate a driving module. For example, as illustrated in FIG. 4, each source interface and each gate interface may be connected to a respective driving module. Each driving module may indicate an individual driver integrated circuit (IC). For example, when there are three source interfaces and two gate interfaces, there may be a total of five driver ICs.

Alternatively, each driving module may indicate an individual output port of a driver IC. For example, when there is one driver IC having five output ports, three source interfaces and two gate interfaces may be connected to each output port of a driver IC. As another alternative, three source interfaces may be connected to one driver IC having three output ports, and two gate interfaces may be connected to another driver IC having two output ports.

In this aspect, regardless of the number of driver ICs, signals output with each of the source interfaces and the gate interfaces can be controlled individually. Detailed operation of the LED display module is similar to that described above with respect to FIG. 3. With each source interface including S1, the driving module may output a source driving signal. The gate driving module may output a gate driving signal to the gate interface including G1. A phase difference between the source driving signal and the gate driving signal may be equal to 180 degrees.

When the driving signal of the first source interface S1 is high and the driving signal of the first gate interface G1 is low, LED D1-1 (item 41), for which the voltage is applied in a positive direction, can operate to emit light. When the driving signal of the first source interface S1 is low and the driving signal of the first gate interface G1 is high, LED D1-2 (item 42), for which the voltage is applied in a positive direction, can operate to emit light. While voltage levels are alternatingly applied to the first source interface S1 and the first gate interface G1, the first LED of the first line and the second LED of the second line can operate to emit light on an alternating basis.

Alternatively, each of the source interfaces can be connected with a driving module and the gate interface can be connected to the ground. In addition, between the gate interface and the ground, a switch can be connected (i.e., interposed). For example, when a high signal is input to the first source interface S1, and the first gate switch is powered on, voltage is applied to LED D1-1 in a positive direction, and as a result, LED D1-1 can emit light. When a low signal is input to the first source interface S1, and the first gate switch is powered on, voltage is applied to LED D1-2 in a positive direction, and as a result, LED D1-2 can emit light. When the gate interface is connected to the ground, there is no driving module connected to the gate interface, and thereby, the structure of the display module can be further simplified.

Further, as illustrated in FIG. 3, according to the combination of signals which are input to the source interface and the gate interface, the display module may configure each LED to emit light in a pixel (dot) unit, area unit, or line unit.

Figure 5:
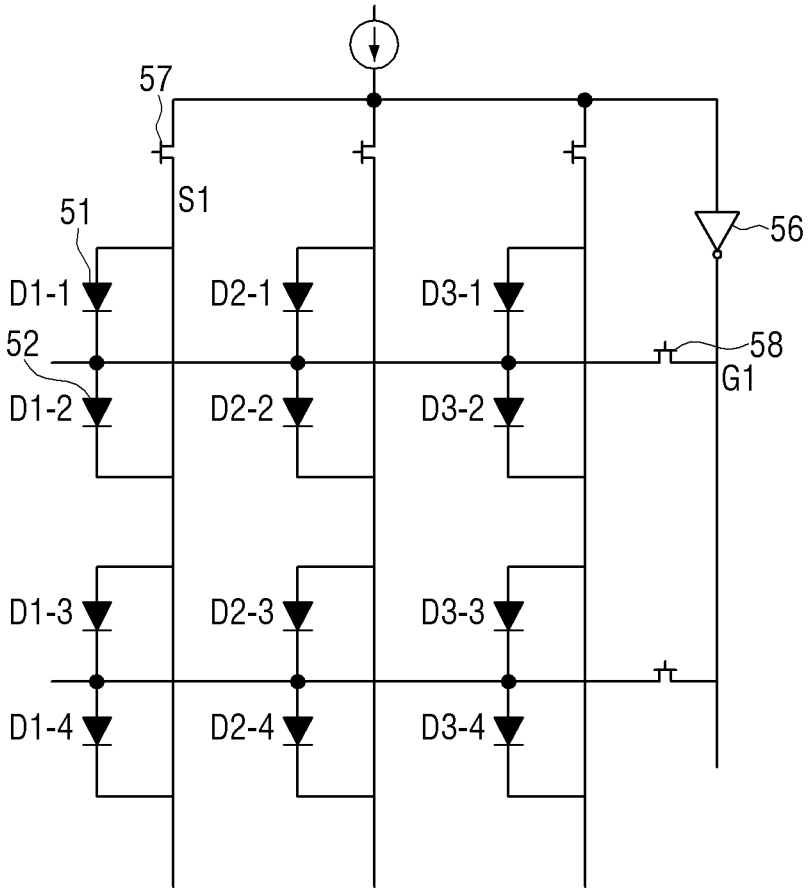
FIG. 5 is a view describing a structure of an LED display module, according to an exemplary embodiment.

FIG. 5 is a view illustrating a structure of the LED display module, according to another exemplary embodiment.

Referring to FIG. 5, a circuit which outputs a driving signal commonly to the source interfaces and the gate interface is illustrated. The source interfaces and the gate interface can be connected to a single driving module. Each of the source interfaces and the gate interface can include a respective switch. In addition, as for the signal which is input to the gate interface, the phase can change by 180 degrees by operation of the inverter 56.

A detailed description of an operation of the LED display module illustrated in FIG. 5 is provided below.

The driving module outputs a high signal. The output high signal can be output via each of the source interfaces and the gate interface. From among the switches connected to each source interface, the first source switch 57 may be the only switch that is powered on. The output high signal can be delivered to the first source interface S1 via the first source switch 57 in a power-on state. Further, the driving signal which is input to the source interface via the inverter 56 can be inverted, i.e., by undergoing a phase change of 180 degrees, in order to be a low signal. In addition, from among the switches connected to the gate interface, the first gate switch 58 may be the only switch that is powered on. A signal for which a phase is changed to low can be transmitted to the first gate interface G1 via the first gate switch in a powered-on state. LED D1-1 (item 51) and LED D1-2 (item 52) are connected to the first source interface S1 and the first gate interface G1. As between LED D1-1 (item 51) and LED D1-2 (item 52), voltage in a positive direction can be applied to LED D1-1 (item 51), and voltage in a reverse direction can be applied to LED D1-2 (item 52). Therefore, LED D1-1 (item 51) can operate to emit light.

The driving module outputs a low signal. The output low signal can be output via each of the source interfaces and the gate interface. The first source switch 57 can be powered on from among the switches connected to each source interface. The output low signal can be delivered to the first source interface S1 via the first source switch 57 in a powered-on state. Further, the phase of the driving signal which is output to the source interfaces via the inverter 56 can be changed by 180 degrees to be a high signal. In addition, from among the switches connected to the gate interface, only the first gate switch 58 can be powered on. The signal for which the phase is changed to high can be delivered to the first gate interface G1 via the first gate switch 58. To the first source interface S1 and the first gate interface G1, LED D1-1 (item 51) and LED D1-2 (item 52) are connected. As between LED D1-1 (item 51) and LED D1-2 (item 52), a voltage can be applied to LED D1-2 (item 52) in a positive direction, and a voltage in a reverse direction can be applied to LED D1-1 (item 51). Therefore, LED D1-2 (item 52) can operate to emit light.

Figure 6:
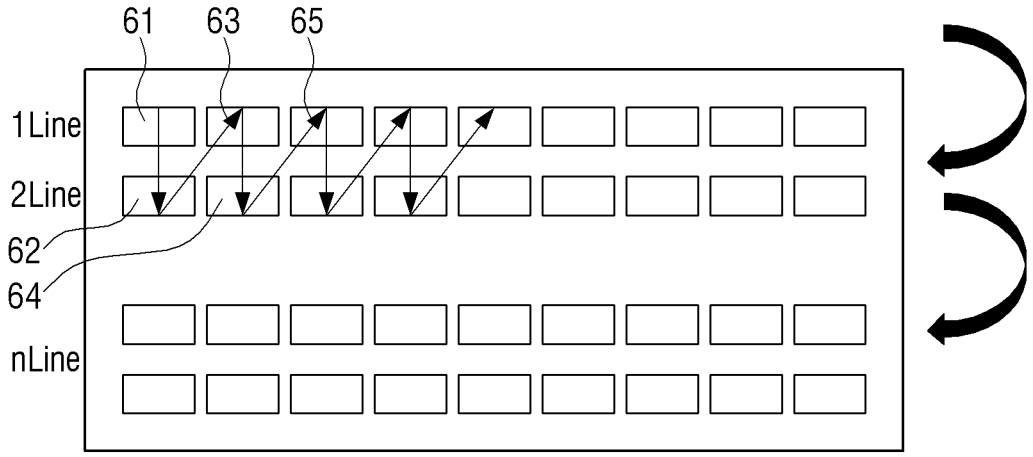
FIG. 6 is a view describing an operation of an LED display module, according to another exemplary embodiment.

FIG. 6 is a view illustrating an operation of the LED display module, according to another exemplary embodiment.

FIG. 6 illustrates a process of controlling lighting of LEDs of the LED display module. As described above, each LED can be controlled by the combination of a signal which is input to the source interface and a signal which is input to the gate interface.

The display module as illustrated in FIG. 5 will be described. The driving module outputs a high signal. From among the output high signals, a signal operated on by the inverter can be converted to low. In addition, the first source switch and the first gate switch can be powered on. Accordingly, a high signal can be applied to the first source interface, and a low signal can be applied to the first gate interface. As a result of the voltage difference between the source interface and the gate interface, LED 61 of the first line can be powered on. Then, the driving module outputs a low signal. From among the output low signals, a signal operated on by the inverter can be converted to high.

In addition, the first source switch and the first gate switch can maintain a powered-on state. Therefore, a low signal can be applied to the first source interface, and a high signal can be applied to the first gate interface. As a result of the voltage difference between the source interface and the gate interface, LED 62 of the second line can be powered on.

The driving module outputs a high signal. From among the output high signals, a signal operated on by an inverter can be changed to low. In addition, the second source switch and the first gate switch can be turned on. Therefore, a high signal can be applied to the second source interface, and a low signal can be applied to the first gate interface. As a result of the voltage difference between the source interface and the gate interface, LED 63 of the first line can be turned on. Then, the driving module outputs a low signal. From among the output low signals, a signal operated on by an inverter can be changed to high. In addition, the second source switch and the first gate switch can maintain a powered-on state. Therefore, a low signal can be applied to the second source interface, and a high signal can be applied to the first gate interface. As a result of the voltage difference between the source interface and the gate interface, LED 64 of the second line can be turned on.

The driving module outputs a high signal. From among the output high signals, a signal operated on by the inverter can be changed to low. In addition, the third source switch and the first gate switch can be turned on. Therefore, a high signal can be applied to the third source interface, and a low signal can be applied to the first gate interface, and as a result of the voltage difference between the source interface and the gate interface, LED 65 of the first line can be turned on. By application of the above-described method, LEDs of the first line and the second line can be sequentially and alternatingly operated to emit light.

As for the display module, the first line and second line LEDs can be sequentially operated to emit light according to a driving method, and third line and fourth line LEDs can be sequentially operated to emit light. Alternatively, the LED display module may sequentially and alternatingly operate the first line and second line LED groups by controlling a plurality of LEDs in one group. As another alternative, the LED display module may operate LEDs by lines, and control two LEDs at the same time by operating LEDs in the same column disposed in the first line and the third line at the same time. In this manner, the display module may control LED lighting by various methods according to types of components, processing speed, and types of images.

In addition, a black matrix can be disposed among the LEDs. A black matrix is constructed by creating a gap between adjacent LEDs and inserting black material inside the gap in order to absorb external light and improve contrast. Each LED can correspond to one pixel, and it may be understood that the black matrix is inserted among the pixels. A length of a black matrix inserted among each pair of LEDs can be the same.

One display module can be embodied as one display panel, and a plurality of display modules which are combined can be embodied as one display panel. When a plurality of the display modules are combined, all the black matrix areas in each module edge part can be the same as the black matrix area between adjacent pixels. Therefore, a bezel area of the display panel can be rarely seen. In addition, the display panel can be included in the display apparatus.

Figure 7:
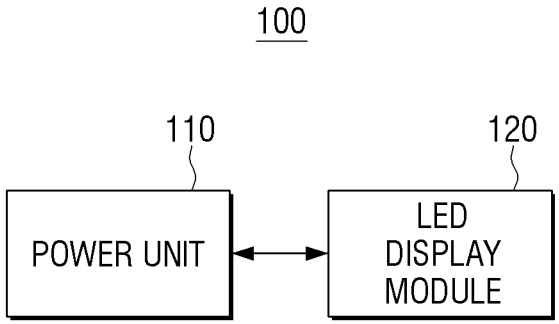
FIG. 7 is a block diagram of a display device, according to an exemplary embodiment.

FIG. 7 is a block diagram of the display apparatus, according to an exemplary embodiment.

FIG. 7 illustrates that the display apparatus 100 may include the power unit (also referred to herein as "power module") 110 and the display module 120. The power unit 110 can provide power to the display apparatus 100 which is supplied from outside. Alternatively, the power unit 110 can provide power of the display apparatus 100 without an external connection, such as, for example, by use of a secondary battery.

The display module 120 may include an LED part that includes a plurality of first LEDs disposed in a first line, and a plurality of second LEDs disposed in a second line, the source interface(s), and the gate interface(s).

The source interface can be commonly connected to an anode of a corresponding one of a plurality of the first LEDs and a cathode of a corresponding one of a plurality of the second LEDs disposed in the same column as the plurality of the first LEDs. In addition, the gate interface can be commonly connected to a cathode of each of a plurality of the first LEDs and an anode of each of a plurality of the second LEDs.

The source interface and the gate interface can receive a driving signal from the driving module. Each of the source interface and the gate interface may be connected to the driving module, or may be commonly connected to one driving module. A phase difference between a driving signal which is input to the source interface and a driving signal which is input to the gate interface can be equal to 180 degrees.

In case of the display module of the display apparatus, when a source driving signal is high (i.e., higher than a predetermined threshold) and the gate driving signal is low (i.e., lower than a predetermined threshold), the first LED of the first line corresponding to the source driving signal can operate, and when the source driving signal is low and the gate driving signal is high, the second LED in the second line disposed in the same column as the first LED can operate.

A detailed description of the structure and operation of the display module are the same as the description above and thus will be omitted. A method of controlling a display module is described hereinbelow.

Figure 8:
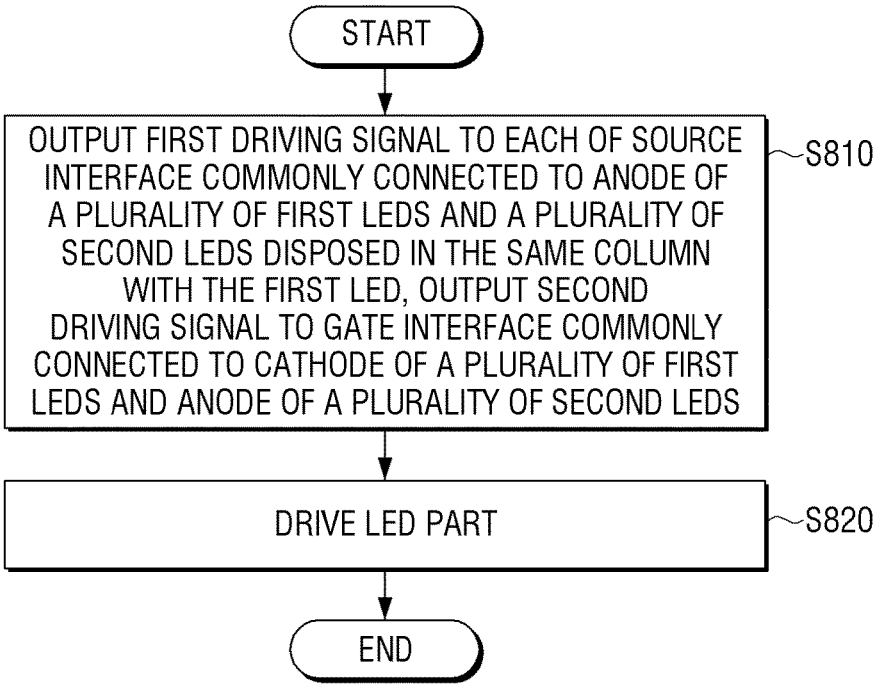
FIG. 8 is a flowchart of a method for controlling an LED display module, according to an exemplary embodiment.

FIG. 8 is a flowchart of a method of controlling of an LED display module, according to an exemplary embodiment.

Referring to FIG. 8, the display module may include an LED part which includes a plurality of first LEDs disposed in a first line and a plurality of second LEDs disposed in a second line.

In operation S810, the display module may output a source driving signal to each of the source interfaces which is commonly connected to an anode of a corresponding one of the plurality of the first LEDs and a cathode of a corresponding one of a plurality of the second LEDs disposed in the same column as the first LED. In addition, the display module may output a gate driving signal to the gate interface which is commonly connected to a cathode of each of a plurality of the first LEDs and an anode of each of a plurality of the second LEDs.

In operation S820, the display module may drive an LED part. Further, a phase difference between the source driving signal and the gate driving signal can be equal to 180 degrees. As a result of the phase difference between the source driving signal and the gate driving signal, an LED of the first line and an LED of the second line can be operated in an alternating manner. Detailed LED operation is described above and thus, further description will be omitted.

In addition, according to an exemplary embodiment, the display module may convert a phase of a source driving signal which is output to each source interface by 180 degrees and then transmit the phase-converted signal to the gate interface. In addition, the display module may output the driving signal to each of the source interface and the gate interface at the same time, and sequentially operate the first LED of the first line and the second LED of the second line alternatingly based on a phase difference between a driving signal which is input to the source interface and a driving signal which is input to the gate interface.

The method for controlling the display module according to various exemplary embodiments can be embodied as a program and provided to a display device. For example, a non-transitory computer readable medium within which a program that performs each step of the controlling method is stored can be provided.

The non-transitory recordable medium refers to a medium which may store data semi-permanently rather than storing data for a short time such as a register, a cache, and a memory, and may be readable by an apparatus. For example, the non-transitory readable medium may include any one or more of CD, DVD, hard disk, Blu-ray disk, USB, memory card, ROM, etc.

As described above, according to various exemplary embodiments, an LED display module, a display apparatus, and a controlling method thereof have a relatively simple structure compared to the related art display panel, and consequently, consumption power can be reduced and a yield of a display apparatus can be improved.

In addition, an LED display module, a display apparatus, and a controlling method thereof have a relatively simple structure and can embody a bezelless display apparatus by connecting several modules, and therefore, a manufacturing expense can be correspondingly reduced.

The foregoing exemplary embodiments and advantages are merely exemplary and are not to be construed as limiting the present inventive concept. The present disclosure can be readily applied to other types of apparatuses. Also, the description of one or more exemplary embodiments is intended to be illustrative, and not to limit the scope of the claims, and many alternatives, modifications, and variations will be apparent to persons of ordinary skill in the art.

What is claimed is:

1. A light-emitting diode (LED) display module comprising:

a plurality of first LEDs arranged in a first line and a plurality of second LEDs arranged in a second line;

a plurality of source interfaces, each source interface being commonly connected to an anode of a corresponding one of the plurality of first LEDs and a cathode of a corresponding one of the plurality of second LEDs arranged in a same column as the corresponding one of the plurality of first LEDs;

a gate interface commonly connected to a cathode of each of the plurality of the first LEDs and an anode of each of the plurality of the second LEDs;

a driving module configured to output a first driving signal to each of the plurality of source interfaces and the gate interface; and an inverter configured to convert a phase of the first driving signal output to each of the plurality of source interfaces by 180 degrees and to transfer the phase-converted first driving signal to the gate interface.

2. The LED display module as claimed in claim 1, wherein, in response to the first driving signal being higher than a threshold and the phase-converted first driving signal being lower than the threshold, a first LED from among the plurality of first LEDs that corresponds to the first driving signal is configured to operate, and in response to the first driving signal being lower than the threshold and the phase-converted first driving signal being higher than the threshold, a second LED from among the plurality of second LEDs that corresponds to the first driving signal is configured to operate.

3. The LED display module as claimed in claim 1, further comprising:

a plurality of first switches, wherein each of the plurality of first switches is interposed between the driving module and a corresponding one of the plurality of first LEDs on each of the plurality of source interfaces; and a second switch interposed between the inverter and a nearest LED from among the plurality of first LEDs and the plurality of second LEDs on the gate interface, wherein, in response to each of the plurality of first switches and the second switch being powered on, at least one LED from among the plurality of first LEDs and the plurality of second LEDs is configured to operate.

4. The LED display module as claimed in claim 3, wherein, in response to each of the plurality of first switches and the second switch being powered on and the first driving signal being higher than a threshold, a first LED from among the plurality of first LEDs that corresponds to the first driving signal is configured to operate, and in response to each of the plurality of first switches and the second switch being powered on and the first driving signal being lower than the threshold, a second LED from among the plurality of second LEDs that corresponds to the first driving signal is configured to operate.

5. The LED display module as claimed in claim 1, further comprising:

a black matrix area disposed between adjacent pairs of LEDs from among the plurality of first LEDs and the plurality of second LEDs.

6. A display device comprising:

a power module; and a light-emitting diode (LED) display module, wherein the LED display module comprises:

a plurality of first LEDs arranged in a first line and a plurality of second LEDs arranged in a second line;

a plurality of source interfaces, each source interface being commonly connected to an anode of a corresponding one of the plurality of first LEDs and a cathode of a corresponding one of the plurality of second LEDs arranged in a same column as the corresponding one of the plurality of first LEDs; and a gate interface commonly connected to a cathode of each of the plurality of the first LEDs and an anode of each of the plurality of the second LEDs;

a driving module configured to output a first driving signal to each of the plurality of source interfaces and the gate interface; and an inverter configured to convert a phase of the first driving signal output to each of the plurality of source interfaces by 180 degrees and to transfer the phase-converted first driving signal to the gate interface.

7. The display device as claimed in claim 6, wherein in response to the first driving signal being higher than a threshold and the phase-converted first driving signal being lower than the threshold, a first LED from among the plurality of first LEDs that corresponds to the first driving signal is configured to operate, and in response to the first driving signal being lower than the threshold and the phase-converted first driving signal being higher than the threshold, a second LED from among the plurality of second LEDs that corresponds to the first driving signal is configured to operate.

8. The display device as claimed in claim 6, wherein the LED display module further comprises:

a plurality of first switches, wherein each of the plurality of first switches is interposed between the driving module and a corresponding one of the plurality of first LEDs on each of the plurality of source interfaces; and a second switch interposed between the inverter and a nearest LED from among the plurality of first LEDs and the plurality of second LEDs on the gate interface, and wherein, in response to each of the plurality of first switches and the second switch being powered on, at least one LED from among the plurality of first LEDs and the plurality of second LEDs is configured to operate.

9. The display device as claimed in claim 8, wherein in response to each of the plurality of first switches and the second switch being powered on and the first driving signal being higher than a threshold, a first LED from among the plurality of first LEDs that corresponds to the first driving signal is configured to operate, and in response to each of the plurality of first switches and the second switch being powered on and the first driving signal being lower than the threshold, a second LED from among the plurality of second LEDs that corresponds to the first driving signal is configured to operate.

10. The display device as claimed in claim 6, wherein the LED display module further comprises a black matrix area disposed between adjacent pairs of LEDs from among the plurality of first LEDs and the plurality of second LEDs.

11. A method for controlling a light-emitting diode (LED) display module comprising a plurality of first LEDs arranged in a first line and a plurality of second LEDs arranged in a second line, the method comprising:

outputting a first driving signal to each of a plurality of source interfaces which are commonly connected to an anode of a corresponding one of the plurality of first LEDs and a cathode of a corresponding one of the plurality of second LEDs arranged in a same column as the corresponding one of the plurality of first LED;

converting a phase of the first driving signal output to each of the plurality of source interfaces by 180 degrees and transferring the phase-converted first driving signal to a gate interface which is commonly connected to a cathode of each of the plurality of the first LEDs and an anode of each of the plurality of the second LEDs; and driving at least one LED from among the plurality of first LEDs and the plurality of second LEDs, wherein the first driving signal is transferred to the gate interface.

12. The method as claimed in claim 11, wherein the driving comprises:

in response to the first driving signal being higher than a threshold and the phase-converted first driving signal being lower than the threshold, driving a first LED from among the plurality of first LEDs that corresponds to the first driving signal, and in response to the first driving signal being lower than the threshold and the phase-converted first driving signal being higher than the threshold, driving a second LED from among the plurality of second LEDs that corresponds to the first driving signal.

13. The method as claimed in claim 11, wherein the driving comprises:

in response to each of a plurality of first switches and a second switch being powered on, wherein each of the plurality of first switches is interposed between a driving module and a corresponding one of the plurality of first LEDs on the each of the plurality of source interfaces and wherein the second switch is interposed between a inverter and a nearest LED from among the plurality of first LEDs and the plurality of second LEDs on the gate interface, driving the at least one LED from among the plurality of first LEDs and the plurality of second LEDs.

14. The method as claimed in claim 13, wherein the driving further comprises:

in response to each of the plurality of first switches and the second switch being powered on and the first driving signal being higher than a threshold, driving a first LED from among the plurality of first LEDs that corresponds to the first driving signal; and in response to each of the plurality of first switches and the second switch being powered on and the first driving signal being lower than the threshold, driving a second LED from among the plurality of second LEDs that corresponds to the first driving signal.

* * * * *